United States Patent [19]

Newcomb et al.

[11] Patent Number: 4,913,437

[45] Date of Patent: Apr. 3, 1990

[54] ILLUMINATED GOLF CLUB

[76] Inventors: Nelson F. Newcomb; Nelson F. Newcomb, Jr., both of Windleblo Rd., Mirror Lake, N.H. 03853

[21] Appl. No.: 361,913

[22] Filed: Jun. 6, 1989

[51] Int. Cl.[4] ..... A63B 53/04; A63B 69/36

[52] U.S. Cl. ..... 273/162 R; 273/186 A; 273/DIG. 24; 273/171

[58] Field of Search ..... 273/DIG. 24, 162 R, 273/163 R, 164, 186 R, 186 A, 186 C, 193 R, 194 R, 194 A, 194 B, 183 D, 171

[56] References Cited

U.S. PATENT DOCUMENTS

| | | | |
|---|---|---|---|
| 280,807 | 7/1883 | Farley | 273/DIG. 024 |
| 3,649,028 | 3/1972 | Worrell | 273/DIG. 024 |
| 3,820,795 | 6/1974 | Taylor | 273/186 A |
| 4,695,055 | 9/1987 | Newcomb et al. | 273/213 |

*Primary Examiner*—George J. Marlo

*Attorney, Agent, or Firm*—Ernest V. Linek; Robert T. Gammons

[57] ABSTRACT

A golf club provided with a head formed of a translucent plastic within which is disposed, preferably adjacent to the striking face, a chemiluminescent light stick.

19 Claims, 1 Drawing Sheet

ILLUMINATED GOLF CLUB

BACKGROUND OF THE INVENTION

In U.S. Pat. No. 4,695,055, there is disclosed and claimed a translucent golf ball embodying a chemiluminescent light stick which enables playing golf when visibility is limited by approaching darkness. The disclosure of this patent is hereby incorporated herein by reference.

Illumination of the golf ball is achieved by inserting an activated chemiluminescent light stick within a diametrical passage formed in the golf ball. As a further aid to playing golf as darkness approaches and in accordance with this invention as herein illustrated, the head of a golf club is modified to similarly be illuminated. Thus this invention is directed to golf clubs (woods, irons, and putter) with the head thereof comprised of a translucent material that is provided with an opening extending from heel to toe, preferably adjacent the striking face of the head, for receiving a chemiluminescent light stick disclosed in U.S. Pat. No. 4,695,055.

INFORMATION DISCLOSURE

In accordance with Applicants duty of disclosure under Rule 56, the following patents are being brought to the attention of the Examiner in connection with the filing of this application:

Newcomb et al., U.S. Pat. No. 4,695,055 which discloses an illuminated translucent golf ball useful herein.

Welch, U.S. Pat. No. 3,918,719, which discloses a method of playing golf at nightemploying portable lights and fluorescent markers on the golfers, golf balls, and the golf course.

Worrell, U.S. Pat. No. 3,649,029, which discloses a golf practice aparatus employing a luminescent decal on the head of a golf club, on the practice mat, with activation in the form of an ultraviolet light.

Farley, U.S. Pat. No. 280,807, which is directed to a luminescent croquet set wherein the balls, mallets, wickets and stakes are treated with a luminous paint for play in the dark.

SUMMARY OF THE INVENTION

As herein illustrated, the invention in the preferred form resides in a golf club in the form of a putter provided with a shaft and a head at one end comprised of a translucent material containing a passage extending longitudinally thereof from head to toe within which is disposed a chemiluminescent light stick. Preferably, the passage is disposed in the head at the inner side with respect to the direction of swing. Optionally or additionally, the passage may be disposed in the head at the middle or outer side thereof.

In this preferred embodiment, the chemiluminescent light stick comprises an elongate cylinder corresponding substantially to the toe to heel length of the head and is of a diameter of approximately ¼ of an inch. Desirably, the passage for receiving the light stick is located parallel to the inner side of the head and parallel to the lower side of the head. Optionally, plugs may be inserted in the open ends of the passage to removably retain the light stick in place.

While the invention is described herein with reference to the preferred embodiment, namely the putter, it will be recognized by those of ordinary skill in the art of golf club manufacture, that the head of a wood (1, 3, 5, etc.) and irons (1–9, pitching and sand wedges) may similarly be fashioned of a translucent plastic and illuminated in accordance with the teachings of this invention. Such alternate embodiments are likewise a part of the presently claimed invention.

BRIEF DESCRIPTION OF THE DRAWINGS

The invention will now be described in greater detail with reference to the accompanying drawings, wherein.

DETAILED DESCRIPTION OF THE PREFERRED EMBODIMENT

When playing golf on days that are overcast, on occasions of approaching darkness, or when playing in tournaments held at night, such as the NITELITE GOLF TOURNAMENT (over 5,200 played in 19 countries—contact Pick Point Sports, (603) 569—1533) it can be difficult to strike the ball accurately, even though a chemiluminescent ball is used as disclosed in U.S. Pat. No. 4,695,055. It is, accordingly, the purpose of this invention to so illuminate the head of the club as to enable closely positioning the head of the club squarely with respect to the direction in which the golfer intends to propel the ball.

Such illumination may be applied not only to putters, but also to drivers and irons. Moreover, the entire head or a given club need not be formed from a translucent plastic to achieve the benefits described herein. Only that portion of the head necessary for sufficient lumination need be modified to accept a chemiluminescent light stick. For example, the striking face, or a portion thereof may be modified with a translucent plastic for retention of an activated light stick.

Figure 1:
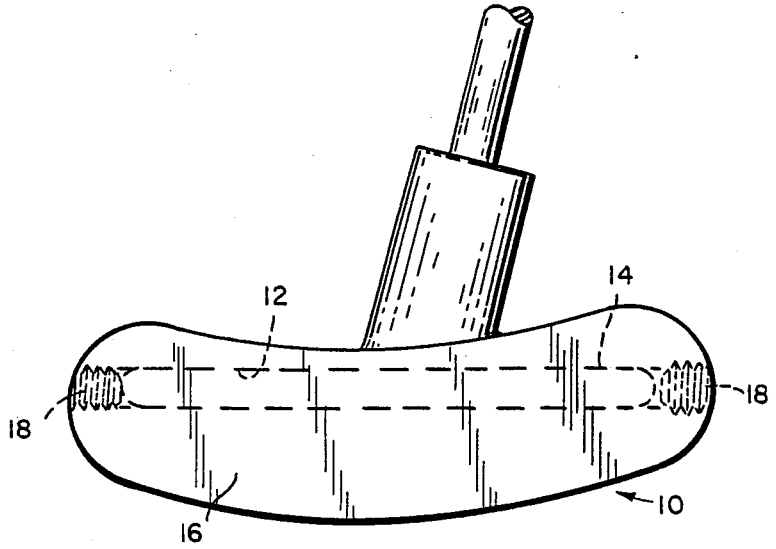
FIG. 1 is a side elevation of the head of a golf club according to this invention showing a passage extending longitudinally from the forward end of the head to the rear end thereof.
Figure 2:
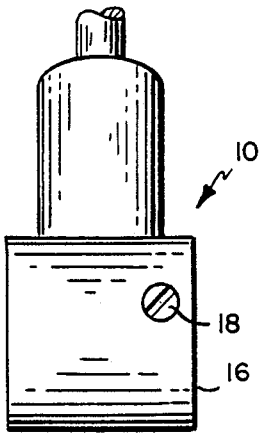
FIG. 2 is a front elevation of the head.
Figure 4:
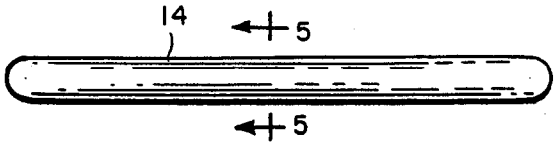
FIG. 4 is an elevation of the chemiluminescent light stick for insertion into the passage in the head.
Figure 3:
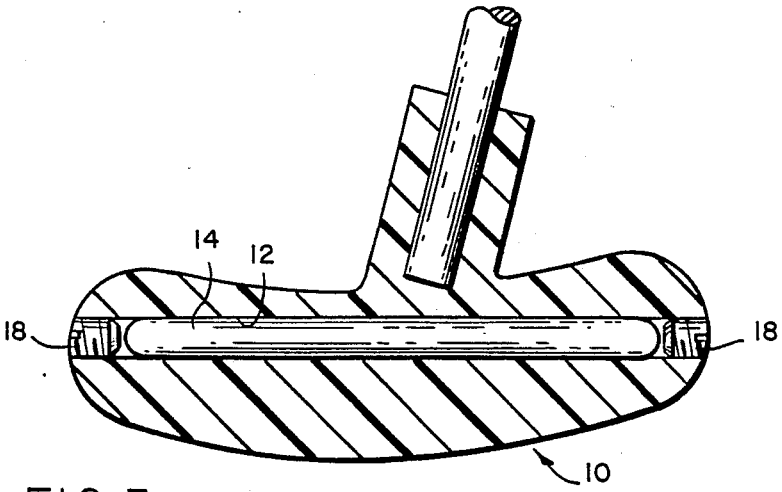
FIG. 3 is a transverse section of the head of a golf club according to this invention showing one preferred placement location of the light stick show in FIG. 4.

Specifically, and in accordance with the preferred form of the invention as herein illustrated, FIGS. 1 and 2, the head 10 of the club is comprised of a translucent plastic material as, for example, polyethylene. The head is provided with a passage 12 extending longitudinally thereof from the forward end to the rear end and an elongate chemiluminescent light stick 14 is disposed therein. The chemiluminescent light stick 14 is of the kind disclosed in the aforesaid patent and, as shown in FIGS. 3 and 4, is cylindrical, is of approximately the length of the head, and is approximately ¼ inch in diameter. Desirably, the passage 12 is located approximately ¼ of an inch from the front side, that is, the striking face 16 of the head of the club. Optionally, the passage 12 for receiving the light stick 14 may be located at the back side of the head or at some intermediate position.

Figure 5:
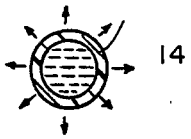
FIG. 5 is a section of the light stick along section 5—5 from FIG. 4.

The chemiluminescent light stick 14, as shown in FIGS. 4 and 5, is force-fitted into the passage 12. Desirably, the light stick 14 is shorter in length than the heel-to-toe length of the head and is positioned therein with its opposite ends spaced from the ends of the head. Optionally, plugs 18—18 may be force-fitted or threaded into the open ends of the passage to retain the light stick in place. The plugs may be removed to permit removal of the light stick for replacement, if necessary. Such plugs are likely to be necessary in woods which impact the ball with much greater force than putters.

The chemiluminescent light stick 14, as shown in FIG. 4, is activated by manually bending it until the vial therein breaks to allow the separated chemicals to mix, thereby to give off a cold luminescence. Such chemiluminescent light sticks are commonly available in the marketplace, made, for example, by American Cyanamide Company of Wayne, New Jersey and sold under the trademark CYALUME®.

It should be understood that the present disclosure is for the purpose of illustration only and includes all modifications or improvements which fall within the scope of the appended claims.

What is claimed is:

1. A golf club comprising a shaft and a head at one end thereof, said head being comprised of a translucent plastic material and embodying a cylindrical chemiluminescent light stick disposed therein.

2. A golf club according to claim 1, wherein the light stick extends from heel to toe.

3. A golf club according to claim 1, wherein the chemiluminescent light stick is disposed at the inner side of the head with respect to the direction of swing.

4. A golf club according to claim 1, wherein the chemiluminescent light stick is disposed therein at the outer side of the head with respect to the direction of swing.

5. A golf club according to claim 1, wherein the chemiluminescent light stick is disposed at the top or upper side of the head.

6. A golf club according to claim 1, wherein the chemiluminescent light stick is disposed therein at the bottom or lower side of the head.

7. A golf club according to claim 1, wherein said chemiluminescent light stick comprises an elongate cylinder corresponding to substantially the toe to heel length of the head and of a diameter of approximately ¼ of an inch.

8. A golf club according to claim 1, wherein the head contains an elongate passage extending from toe to heel and wherein the chemiluminescent light stick is disposed in the passage and retained therein by friction.

9. A golf club according to claim 8, wherein the elongate passage is located at a distance of ¼ inch from the inner face of the head.

10. A golf club according to claim 9, wherein the elongate passage is located substantially midway between the bottom side and the top side of the head.

11. A golf club according to claim 1, wherein the head contains an elongate passage extending from toe to heel and wherein the chemiluminescent light stick is disposed in the passage and retained therein by plugs inserted into the open ends of the passage.

12. A golf club according to claim 11, wherein the elongate passage is located at a distance of ¼ inch from the inner face of the head.

13. A golf club according to claim 12, wherein the elongate passage is located substantially midway between the bottom side and the top side of the head.

14. A golf club according to claim 11, wherein the plugs are removably inserted into the ends of the passage such as to enable removing them for replacing the light stick.

15. A golf club according to claim 1, wherein the head is comprised of a translucent plastic material selected from polyethylene polymers and PVC polymers, and the light stick is comprised of a comparable translucent plastic material.

16. A golf club comprising a shaft and translucent head embodying a chemiluminescent module.

17. A golf club comprising a shaft and a head comprised at least in part of a translucent material, said club embodying a chemiluminescent module.

18. A golf club comprising a shaft and a head provided with a striking face embodying a chemiluminescent module.

19. A golf club comprising a shaft and a head attached to one end of the shaft, characterized in that the head embodies a chemiluminescent module.

* * * * *